United States Patent [19]

Fujii

[11] Patent Number: 4,815,669

[45] Date of Patent: Mar. 28, 1989

[54] SHREDDER

[75] Inventor: Yoshihalu Fujii, Sakurai, Japan

[73] Assignee: Sharp Kabushiki Kaisha, Osaka, Japan

[21] Appl. No.: 93,236

[22] Filed: Sep. 4, 1987

[30] Foreign Application Priority Data

Sep. 8, 1986 [JP] Japan ..... 61-211111

[51] Int. Cl.[4] ..... B02C 25/00

[52] U.S. Cl. ..... 241/34; 241/236; 271/258

[58] Field of Search ..... 241/34, 33, 36, 236, 241/243, 224; 271/256, 258, 262, 225, 259

[56] References Cited

U.S. PATENT DOCUMENTS 3,614,419 10/1971 Daughton ..... 271/262 X 4,057,243 11/1977 Fujimoto ..... 271/256

4,192,467 3/1980 Hatanaka ..... 241/34

*Primary Examiner*—Timothy V. Eley

*Assistant Examiner*—Joseph M. Gorski

*Attorney, Agent, or Firm*—Birch, Stewart, Kolasch, & Birch

[57] ABSTRACT

A shredder including a storage device for placing a number of documents to be shredded, a separate transport device for transporting the documents at least one sheet by one sheet, a transport preventing device for preventing transport of an unsuitable document incapable of being shredded by the shredder, a transport path for transporting the documents to shredding blades, a detection member for detecting the documents, which is provided in the transport path and a control circuit which stops the separate transport device when a signal indicative of absence of the documents has been outputted at a predetermined time by the detection member.

8 Claims, 2 Drawing Sheets

SHREDDER

BACKGROUND OF THE INVENTION

The present invention relates to a shredder having a document feeding function, in which a number of documents stacked on a document feeding tray are delivered, at least, one sheet by one sheet to a pair of shredding blades so as to be shredded by the shredding blades.

Conventionally, in shredders including a feed roller for feeding documents stacked on a document feeding tray and means for preventing many of the documents from being transported at a time, the documents are fed, at least, one sheet by one sheet through separation of the documents by the feed roller and are delivered from a transport path to a pair of shredding blades so as to be shredded by the shredding blades: In the known shredders, documents to be shredded under conditions exceeding strength and a maximum rotational load of the shredding blades are prevented from being transported to the shredding blades by decreasing curvature and size of the transport path. Namely, generally, as thickness of documents increases, stiffness of the documents increases. Hence, the thick documents cannot follow the small curvature and thus, stop in the course of the transport path.

In the known shredders of the above described arrangement, in the case where documents incapable of being shredded by the known shredders are fed into the known shredders, transport of the documents is stopped. However, if this state of stop of transport of the documents is continued, wear of the feed roller is caused, thereby resulting in deterioration of document feeding capability of the feed roller.

Meanwhile, in prior art shredders for automatically shredding a number of documents, the operator may sometimes leave the shredders. Thus, such a phenomenon may take place in which a long time period elapses before the operator becomes aware of stoppage of transport of the documents. As a result, the feed roller is subjected, for a long time, to wear due to its drive, thus resulting in damage to the feed roller.

SUMMARY OF THE INVENTION

Accordingly, an essential object of the present invention is to provide a shredder in which a feed roller, etc. are protected by preventing feed and transport of documents incapable of being shredded by the shredder and by controlling stoppage of the drive for the feed roller, etc., with substantial elimination of the disadvantages inherent in conventional shredders of this kind.

In order to accomplish this object of the present invention, a shredder embodying the present invention comprises: a storage means for placing thereon a number of documents to be shredded; a separate transport means for transporting the documents, at least, one sheet by one sheet through separation of the documents; a transport preventing means for preventing transport of an unsuitable document incapable of being shredded by said shredder; a transport path for transporting the documents to shredding blades; a detection means for detecting the documents, which is provided in said transport path; and a control circuit which stops said separate transport means when a signal indicative of absence of the documents has been output at a predetermined time by said detection means.

In the shredder of the present invention, when a number of the documents are placed on the storage means such as a tray, the documents are delivered towards the transport path by the separation transport means such as a first feed roller disposed above the documents. At this time, a friction plate of the separate transport means prevents a plurality of the documents from being simultaneously transported. Meanwhile, in the case where an unsuitable document incapable of being shredded has been inserted into the documents, transport of the unsuitable document is stopped by the transport preventing means. The control circuit makes, through determination of presence and absence of the documents on the tray, a decision as to whether or not the document detection switch is in the ON state upon lapse of a predetermined time period after start of feed of the documents. At this time, if the document detection switch is not in the ON state, drive of the first feed roller is stopped. Thus, wear of the first feed roller due to its drive is prevented and damage of the first feed roller under abnormal operating conditions is prevented.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

This object and features of the present invention will become apparent from the following description taken in conjunction with the preferred embodiment thereof with reference to the accompanying drawings, drawings which are given by way of illustration only, and thus, are not limitative of the present invention, and in which:

FIG. 4 is an electrical circuit diagram of a control circuit employed in the shredder of FIG. 1.

Before the description of the present invention proceeds, it is to be noted that like parts are designated by like reference numerals throughout the several views of the accompanying drawings.

DETAILED DESCRIPTION OF THE INVENTION

Figure 1:
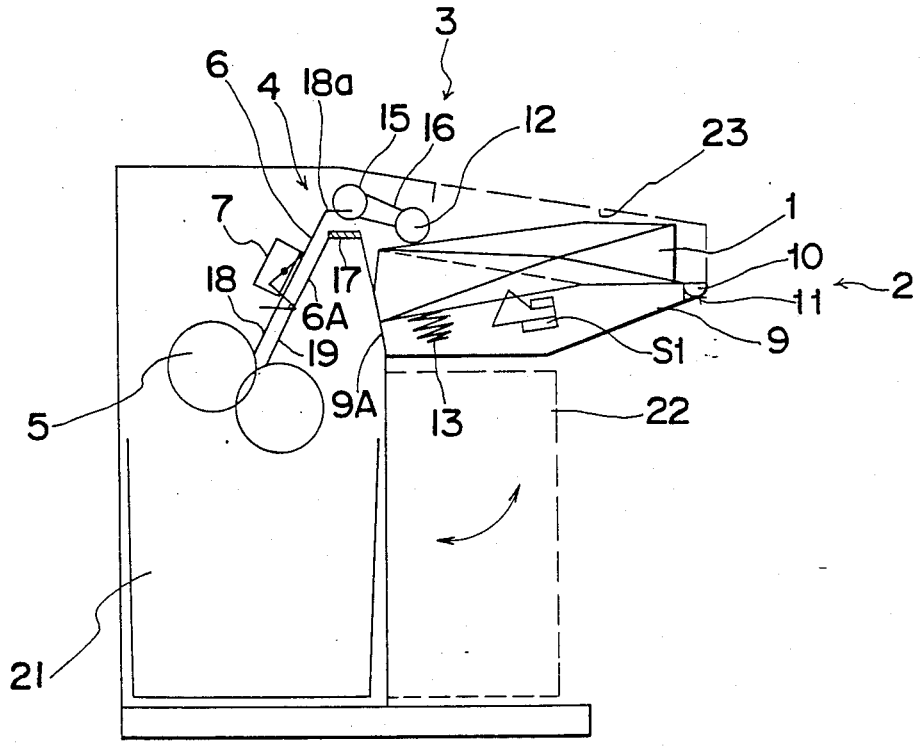
FIG. 1 is a schematic view of a shredder according to one preferred embodiment of the present invention.
Figure 2:
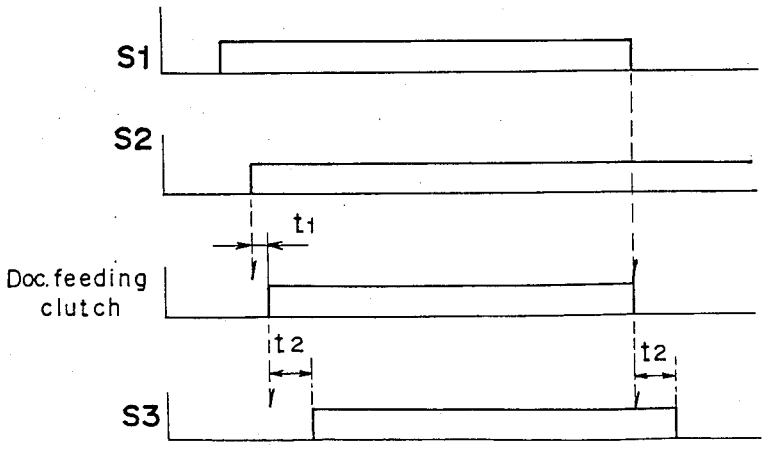
FIG. 2 is a time chart indicative of control of the shredder of FIG. 1.
Figure 3:
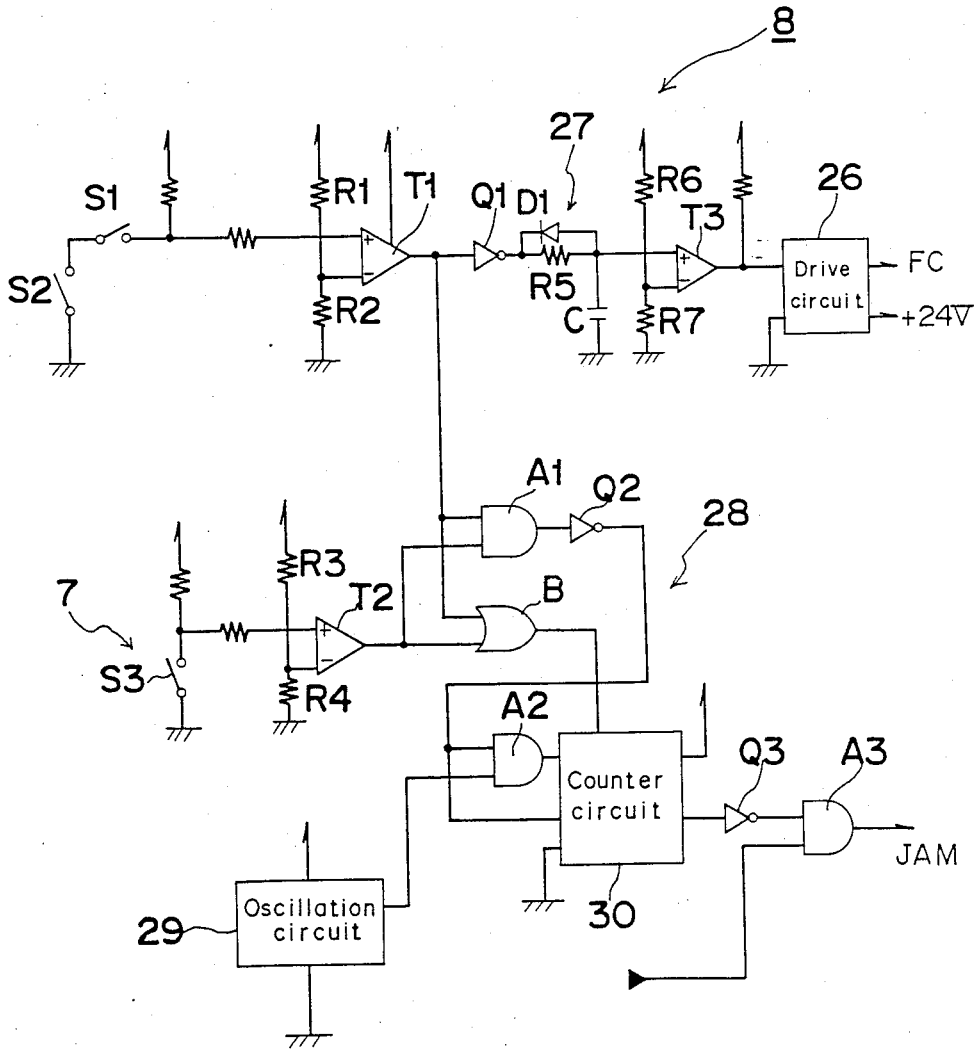

Referring now to the drawings, there is shown in FIGS. 1 to 3, a shredder according to one preferred embodiment of the present invention. As shown in FIG. 1, the shredder includes a storage device 2 for placing thereon a number of documents 1 to be shredded, a separate transport device 3 for transporting the documents 1 at least one sheet by one sheet, a transport preventing device 4 for preventing transport of the documents 1 incapable of being shredded by the shredder, a transport path 6 for transporting the documents 1 to a pair of shredding blades 5, a document sensor 7 provided in the transport path 6 and a control circuit 8 which stops the separate transport device 3 when a typical indicative of absence of the document 1 has been outputted at a predetermined time by the document sensor 7.

The storage device 2 is constituted by a tray 11 for placing the documents 1 thereon and a spring 13 for urging a rear end of the tray 11 upwardly so as to bring an uppermost one of the documents 1 on the tray 11 into contact with a first feed roller 12. The tray 11 is pivotally mounted, at its front end, on a shredder housing 9 through a transverse shaft 10. A detection switch S1 for detecting presence and absence of the documents 1 placed on the tray 11 is retractably provided at a central portion of the tray 11.

The separate transport device 3 is constituted by the first feed roller 12, a second feed roller 15, a belt 16 for driving the first and second feed roller 12 and 15 synchronously and a friction plate 17 for preventing a plurality of the documents 1 from being simultaneously transported. The first feed roller 12 is rotatably supported by the shredder housing 9 so as to be disposed above the tray 11, while the friction plate 17 is made of synthetic rubber and is bonded to an upper face of a support stand 9A of the shredder housing 9 so as to be disposed below the second feed roller 15.

The transport preventing device 4 is constituted by a bent portion 18*a* of an upper end of an upper guide plate 18 of the transport path 6 disposed obliquely downwardly from the friction plate 17 and the friction plate 17. The upper end of the upper guide plate 18 of the transport path 6 is bent horizontally forwardly and the friction plate 17 is disposed horizontally. As the documents 1 become large in thickness, stiffness of the documents 1 increases. Therefore, when the documents 1 are large in thickness, the document 1 conveyed horizontally by the first and second feed rollers 12 and 15 cannot follow the bent portion 18*a* of the upper guide plate 18 with the result that the document 1 stops in the course of the transport path 6.

The transport path is defined between the upper guide plate 18 and a lower guide plate 19 extending downwardly and rearwardly in parallel with each other. A pair of a the shredding blades 5 are of rotary type and are rotatably supported by the shredder housing 9. The shredder further includes a storage container 21, a door 22 and a cover 23.

Hereinbelow, the control circuit 8 is described with reference to FIG. 3. The control circuit 8 is constituted by a first operational amplifier T1, a delay circuit 27, a second operational amplifier T2 and a timer circuit 28. On-off signals of an operation switch S2 and the detection switch S1 are applied to the non-inverting input of the first operational amplifier T1, while a voltage divided by resistors R1 and R2 is applied to the inverting input of the first operational amplifier T1. In response to an output signal of the first operational amplifier T1, the delay circuit 27 outputs, after a delay of a first time period t1, a signal to a drive circuit 26 for driving a document feeding clutch to the first and second feed rollers 12 and 15. A signal of a detection switch S3 acting as the above described document sensor 7 is applied to the non-inverting input of the second operational amplifier T2, while a voltage divided by resistors R3 and R4 is applied to the inverting input of the second operational amplifier T2. When a signal indicative of absence of the document 1 has been outputted continuously during a second time period t2 by the second operational amplifier T2, the timer circuit 28 outputs a jam signal indicative of jamming of the documents 1.

The delay circuit 27 includes a third operational amplifier T3. The output terminal of the first operational amplifier T1 is connected to the non-inverting input of the third operational amplifier T3 through a capacitor C, a resistor R5, an inverter Q1 and a diode D1, while the junction of resistors R6 and R7 is connected to the inverting input of the third operational amplifier T3.

The timer circuit 28 is constituted by a first AND circuit A1, a second AND circuit A2, a counter circuit 30 and an OR circuit B for resetting the counter circuit 30. One input terminal of the first AND circuit A1 is connected to the output terminal of the first operational amplifier T1, while the other input terminal of the first AND circuit A1 is connected to the output terminal of the second operational amplifier T2. One input terminal of the second AND circuit A2 is connected, through a inverter Q2, to the output terminal of the first AND circuit A1, while the other input terminal of the second AND circuit A2 is connected to an oscillation circuit 29. In response to an output signal of the second AND circuit A2, the counter circuit 28 outputs, after the second time period t2, a signal (high level signal) indicative of absence of the document 1 to a third AND circuit A3 via an invertor Q3. One input terminal of the OR circuit B is connected to the output terminal of the first operational amplifier T1, while the other input terminal of the OR circuit B is connected to the output terminal of the second operational amplifier T2.

By the above described arrangement of the shredder, a number of the documents 1 to be shredded are placed on the tray 11. Then, the tray 11 is pivoted according to the quantity of the documents 1 by the urging force of the spring 13 such that an uppermost one of the documents 1 is brought into contact with the first feed roller 12. When the first feed roller 12 is driven in this state, the uppermost one of the documents 1 is carried towards the transport path 6 by the first feed roller 12. At this time, the friction plate 17 prevents a plurality of the documents 1 from being transported at a time. By bending the transport path 6 following the friction plate 17, the documents 1 are transported one sheet by one sheet through separation of the documents 1. Subsequently, the document 1 is delivered from a straight transport portion 6A to the shredding blades 5. Therefore, transport stoppage of the document 1 does not take place in the straight transport portion 6A. The document 1 delivered to the shredding blades 5 is conveyed through the transport path 6 by a shredding force of the shredding blades 5. The feed roller 12 carries to the transport path 6 and the shredding blades 6 a plurality of the documents 1 overlapping in a beltlike manner. At this time, even if an unsuitable document incapable of being shredded is inserted into the documents 1, transport of the unsuitable document is stopped by the transport preventing device 4. However, unless the detection switch S1 provided on the upper face and the lower face of the tray 11 is turned off, drive of the feed roller 12 is continued.

When transport of the unsuitable document incapable of being shredded stops due to insertion of the unsuitable document into the documents 1, the detection switch S3 provided in the course of the straight transport portion 6A detects presence and absence of the document 1. Only in the case where the detection switch S3 has detected that no document 1 has passed through the straight transport portion 6A during the second time period t2, drive of the first feed roller 12 is stopped. The second time period t2 is determined on the basis of a time period required for transporting the document 1 to the detection switch S3 through drive of the first feed roller 12, namely, transport speed and transport distance of the document 1.

Hereinbelow, control of the shredder is described with reference to FIGS. 2 and 3. When the documents 1 are placed on the tray 11, the detection switch S1 is turned on so as to indicate that there are the documents 1 on the tray 11. When the document feed start switch (operation switch) S2 is turned on, the first feed roller 12 is driven. If the document 1 capable of being shredded is transported, the detection switch S3 is turned on after the second time period t2.

On the other hand, if an unsuitable document incapable of being shredded is fed, the unsuitable document does not pass through the transport path 6 after the second time period t2. Hence, the second time period t2 is counted by the timer circuit 28. If an ON signal is not outputted from the detection switch S3 upon lapse of the second time period t2, the jam signal indicative of jamming of the documents 1 is outputted and the first feed roller 12 is stopped.

In FIG. 3, when the detection switch S1 and the operation switch S2 are turned on, a low level signal is generated from the first operational amplifier T1, so that the drive circuit 26 is turned on by way of the inverter Q1 and thus, the first feed roller 12 is driven. At this time, since the detection switch S3 is still held in the OFF state, the first AND circuit A1 outputs a low level signal and the second AND circuit A2 outputs a high level signal by the inverter Q2 such that time counting is started by the counter circuit 30. If the detection switch S3 is turned on prior to lapse of the second time period t2 during this time counting of the counter circuit 30, a low level signal is outputted from the second operational amplifier T2, so that the OR circuit B outputs a low level signal and thus, the counter circuit 30 is reset.

On the contrary, if the detection switch S3 is not turned on during the second time period t2, a high level signal is outputted from the counter circuit 30 and a low level signal is outputted from the third AND circuit A3 through the inverter Q3, so that the first feed roller 12 is stopped. When the detection switch S1 is turned off, a high level signal is outputted from the first operational amplifier T1 and thus, the drive circuit 26 is turned off.

As described above, through determination of presence and absence of the documents 1 on the tray 11, a decision is made as to whether or not the detection switch S3 is in the ON state upon lapse of the second time period t2 after start of feed of the document 1. If the detection switch S3 is not in the ON state, drive of the first feed roller 12 is stopped. Thus, wear of the first feed roller 12 due to its drive is prevented and damage of the first feed roller 12 under abnormal operating conditions is prevented.

Meanwhile, it is to be noted that the present invention is not limited to the above described embodiment and can be modified or changed variously. For example, the control circuit 8 of FIG. 3 can also be replaced by a microcomputer.

As is clear from the foregoing description, in the shredder of the present invention, in the case where an unsuitable document incapable of being shredded has been inserted into the document, transport of the unsuitable document is stopped by the transport preventing device and the control circuit makes, through determination of presence and absence of the document on the tray, a decision as to whether or not the detection switch is in the ON state upon lapse of a predetermined time period after start of feed of the document. If the detection switch is not in the ON state, drive of the first feed roller is stopped. Thus, such remarkable effects can be achieved that wear of the first feed roller due to its drive is prevented and damage of the first feed roller under abnormal operating conditions can be prevented.

Although the present invention has been fully described by way of example with references to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A shredder comprising:

storage means for receiving a plurality of documents to be shredded;

transport means for transporting the documents, at least one sheet by one sheet through separation of the documents;

transport preventing means for preventing transport of an unsuitable document incapable of being shredded by said shredder;

shredding blades for shredding the documents;

a transport path for transporting the documents to the shredding blades;

first detection means for detecting presence of the documents placed on said storage means;

second detection means for detecting the documents, said second detection means being provided in said transport path; and a control circuit which stops operation of said transport means when the documents are being detected by said first detection means and when a signal indicative of absence of the documents has been outputted for a preset time period by said second detection means, said control circuit comprises a first operational amplifier for outputting in response to said first detection means, a signal to a drive circuit for driving said transport means, a second operational amplifier for outputting a signal in response to said second detection means, and a timer circuit responsive to said first and second operational amplifiers.

2. The shredder as claimed in claim 1, wherein said storage means includes a tray mounted pivotally on said shredder and an elastic member for urging said tray towards said transport means.

3. The shredder as claimed in claim 1, wherein said transport means includes a first feed roller, a second feed roller, a belt for driving said first feed roller and said second feed roller synchronously and a friction plate for preventing a plurality of the documents from being transported at a time.

4. The shredder as claimed in claim 1, wherein said transport path is defined between a first guide plate and a second guide plate.

5. The shredder as claimed in claim 1, wherein said transport preventing means includes a bent end portion of a guide plate and a friction plate.

6. The shredder as claimed in claim 1, wherein said detection means comprises a detection switch.

7. The shredder as claimed in claim 1, wherein said control circuit comprises a microcomputer.

8. The shredder as claimed in claim 1, wherein said control circuit further comprises a delay circuit.

* * * * *